US006752180B2

(12) United States Patent
Delay

(10) Patent No.: US 6,752,180 B2
(45) Date of Patent: Jun. 22, 2004

(54) DEVICE FOR THE BIDIRECTIONAL TRANSFER OF A LIQUID BETWEEN A VIAL AND A CARPULE

(75) Inventor: Jean-Pascal Delay, Ecully (FR)

(73) Assignee: Sedat, Irigny (FR)

( * ) Notice: Subject to any disclaimer, the term of this patent is extended or adjusted under 35 U.S.C. 154(b) by 126 days.

(21) Appl. No.: 10/235,727

(22) Filed: Sep. 6, 2002

(65) Prior Publication Data

US 2003/0055376 A1 Mar. 20, 2003

(30) Foreign Application Priority Data

Sep. 17, 2001 (FR) ..... 01 12007

(51) Int. Cl.[7] ..... B65B 1/04; B65B 3/04; B67C 3/02

(52) U.S. Cl. ..... 141/97; 141/311 R; 141/319; 141/329; 141/330; 141/346; 141/363; 141/364; 141/365; 141/366; 141/369; 141/383

(58) Field of Search ..... 414/97, 311 R, 414/319, 329, 330, 346, 363–366, 369, 383, 384; 604/192, 201, 403, 411, 412, 413, 416

(56) References Cited

U.S. PATENT DOCUMENTS

| | | | | |
|---|---|---|---|---|
| 3,336,924 A | | 8/1967 | Sarnoff et al. | |
| 3,826,260 A | | 7/1974 | Killinger | |
| 3,872,867 A | * | 3/1975 | Killinger | 604/413 |
| 5,292,318 A | * | 3/1994 | Haber et al. | 604/407 |
| 5,526,853 A | * | 6/1996 | McPhee et al. | 141/329 |
| 5,649,912 A | | 7/1997 | Peterson | |
| 6,113,583 A | | 9/2000 | Fowles et al. | |

FOREIGN PATENT DOCUMENTS

| | | |
|---|---|---|
| CH | 676548 | 2/1991 |
| FR | 2284339 | 4/1976 |
| FR | 2790948 | 3/1999 |

* cited by examiner

*Primary Examiner*—Timothy L. Maust
(74) *Attorney, Agent, or Firm*—Sughrue Mion, PLLC

(57) ABSTRACT

A device for bidirectional transfer between a vial and a carpule. The device having a body fastened to the vial, a hollow needle, a moving element which is displaceable with respect to the body along the axis of the needle, a carpule reservoir constrained to moved axially in the direction of the axis of the needle, and a distance sleeve interposed between the body and the puncturable piston of the carpule. The distance sleeve forms a limit stop for the puncturable piston with respect to the body. The hollow needle is rigidly joined to the body and is axially fixed with respect to the body.

4 Claims, 5 Drawing Sheets

DEVICE FOR THE BIDIRECTIONAL TRANSFER OF A LIQUID BETWEEN A VIAL AND A CARPULE

The present invention relates to a device for the bidirectional transfer of a liquid between a vial equipped with a puncturable stopper and a carpule comprising a cylindrical reservoir in which a puncturable piston slides, said device comprising:

- a body having means for fastening on the vial;
- a hollow needle presenting a first extremity for puncturing the piston of the carpule and a second extremity adapted for puncturing the stopper of the vial;
- a moving element which is displaceable with respect to the body along the axis of the needle, said moving element having means for constraining the reservoir of the carpule to move axially in the direction of the axis of the needle; and
- a distance sleeve interposed between the body and the puncturable piston of the carpule, said distance sleeve forming a limit stop for the puncturable piston with respect to the body.

Such a bidirectional transfer device is notably described in French Patent Application No. 2,790,948.

In that document the needle providing the means for the carpule and the vial to communicate is carried by a puncturable shuttle which is initially free to slide axially with respect to the body.

The operating sequence of said device is relatively complex.

It is the object of the invention to propose a transfer device with a simplified operating sequence.

To this end, the object of the invention is a bidirectional transfer device of the foregoing type, characterised in that the hollow needle is rigidly joined to the body and is axially fixed with respect to the body.

Under specific embodiments of the invention, the transfer device has one or more of the following features:

- said distance sleeve is displaceable with respect to the body between an initial position in which it holds the puncturable piston away from the first extremity of the needle and a final position in which the needle is engaged through the puncturable piston,
- the moving element and the body have means for limiting the displacement of the moving element with respect to the body in the direction in which the puncturable piston is withdrawn from the cylindrical reservoir,
- the moving element and the body have means for translatory guidance and for rotational immobilisation in relation to one another.

The invention will be more readily understood from reading the following description, which is given solely by way of example and refers to the drawings, in which.

Figure 1:
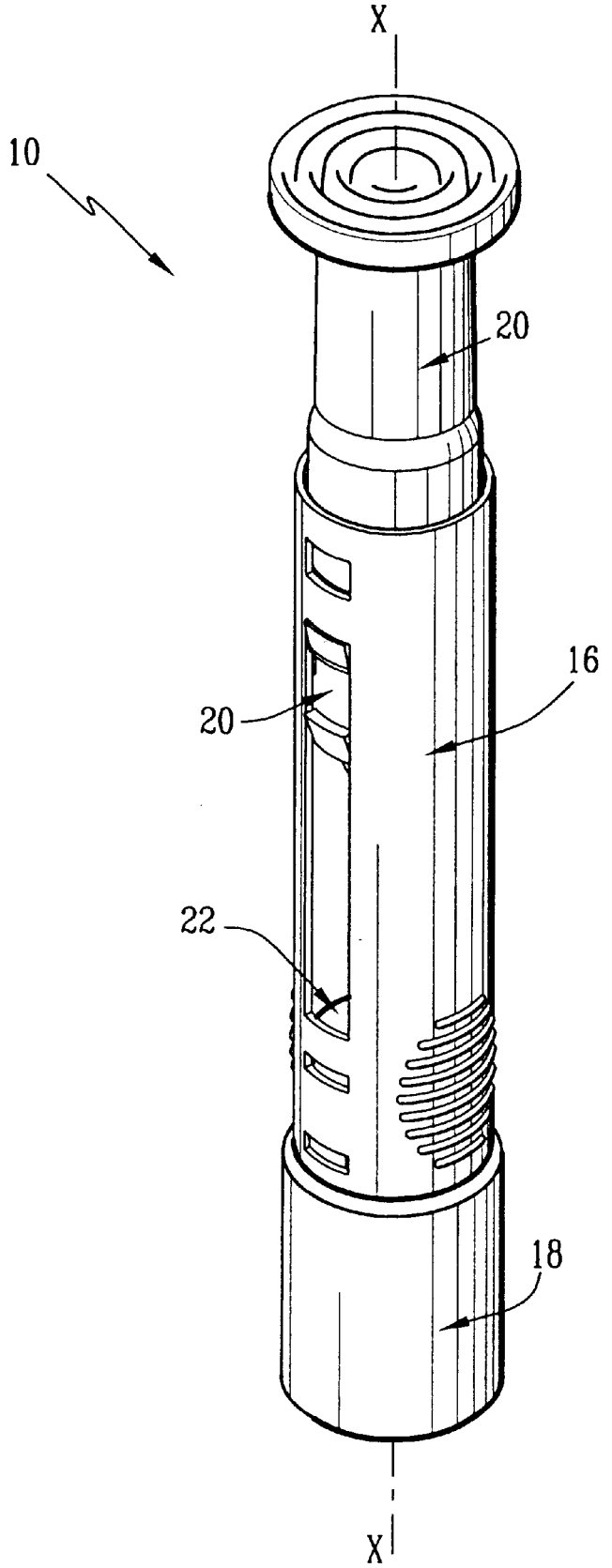
FIG. 1 is a perspective view of the transfer device according to the invention.

The transfer device 10 depicted in FIG. 1 is of a generally cylindrical form with an axis X—X. It is adapted to provide bidirectional transfer of a fluid between a carpule 12, visible in FIGS. 2 and 4, and a vial 14, visible in the same figures.

The device 10 essentially includes a body 16 featuring, at a bottom end, means 18 for fastening on the vial, a moving element 20 for supporting the body of the carpule, said element being adapted to slide with respect to the body 16, and a distance sleeve 22 which forms a plunger adapted to rest on the piston of the carpule 12.

Figure 2:
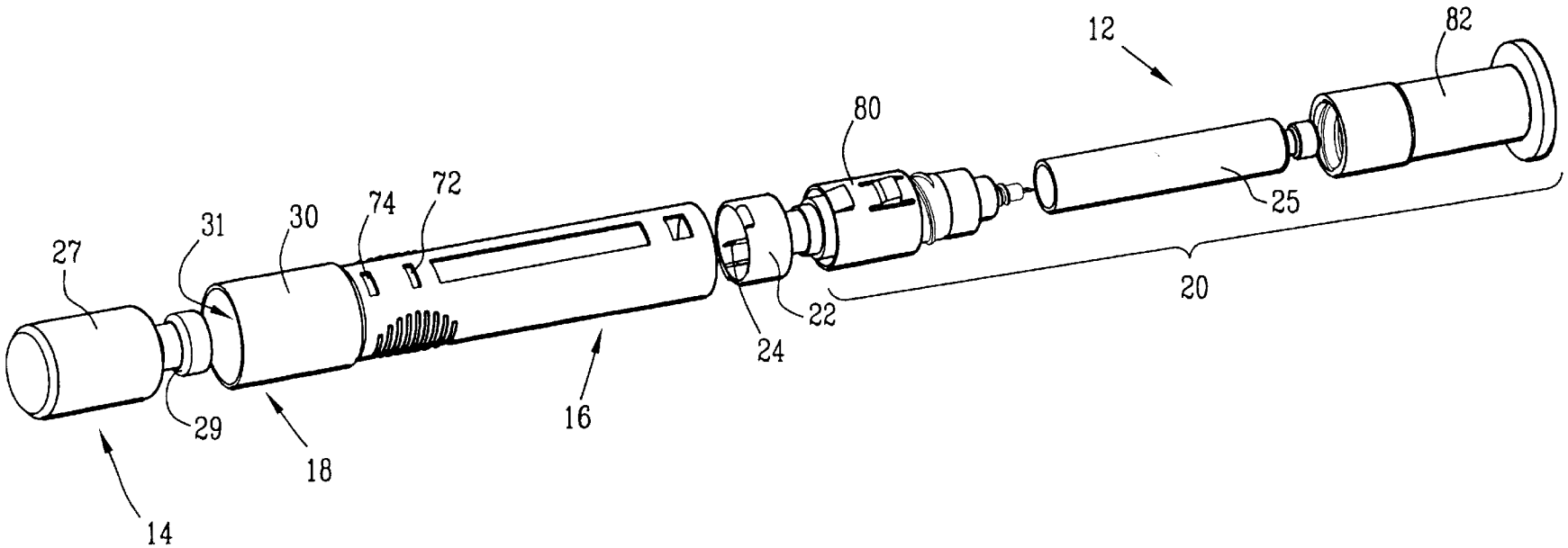
FIG. 2 is an exploded perspective view of the transfer device seen in FIG. 1, connected to a vial and to a carpule.

The device further has a hollow needle 24 rigidly joined to the body 16. In FIG. 2 said needle 24 is shown spaced apart from the body 16 in order to be visible.

Figure 4:
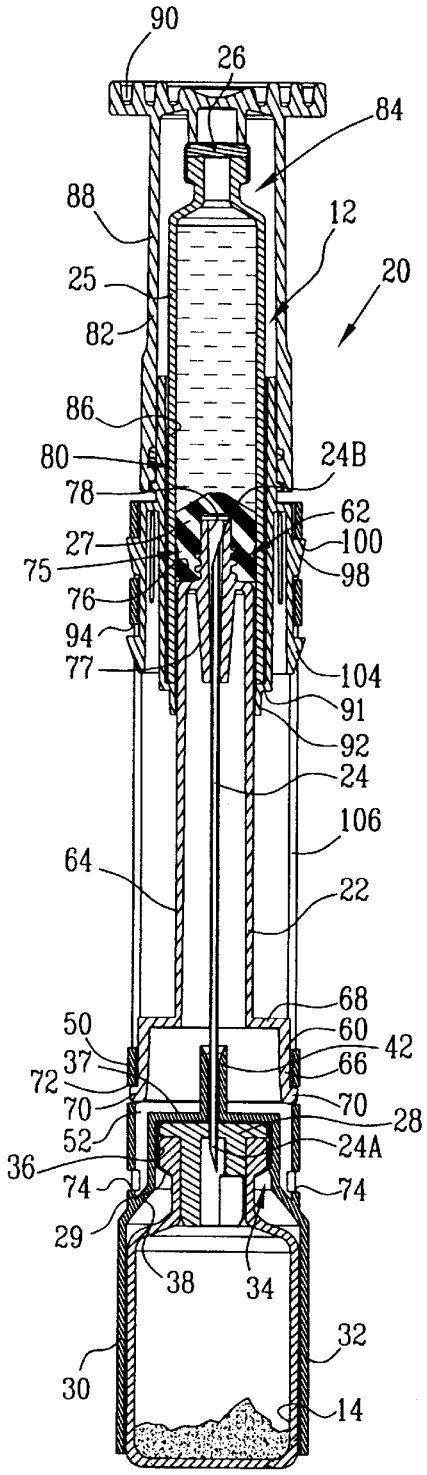
FIGS. 4, 5, 6 and 7 are longitudinal sectional views of the transfer device connected to a vial and to a carpule, depicted at successive stages of use.

As known per se and as illustrated in FIG. 4, the carpule 12 is designed to give an injection after having been withdrawn from the transfer device and fitted with an injection needle and with an operating plunger. It has a cylindrical reservoir 25 presenting, at the front, a constricted neck which is obturated by a puncturable inner capsule 26. The inner capsule 26 is adapted to be punctured by an injection needle mounted on the carpule in readiness for giving an injection. The carpule further has a puncturable piston 27 which slides axially inside the reservoir 25. Initially the carpule contains a solvent.

The vial 14 has a glass body incorporating a mouth obturated by a puncturable inner capsule 28. The mouth exhibits a peripheral rim which defines a collar 29. The vial 14 initially contains a freeze-dried substance which must be dissolved in the solvent that is contained in the carpule.

As the Figures illustrate, the body 16 is of a generally tubular shape. At its bottom end it features a cap 30 which delimits a housing 31 for receiving the vial 14. The housing 31 is defined by a cylindrical wall 32 obturated by a bowl 34 for receiving the mouth of the vial 14. The bowl 34 is delimited laterally by a cylindrical wall 36 of smaller diameter than the cylindrical wall 32. It is obturated by a transverse wall 37 which forms the base. The bowl is joined to the cylindrical wall 32 by a tapered section 38.

Incorporated on the internal surface of the cylindrical wall 32 are projections 40 which make it possible for the vial to be retained axially by flexible interlocking of the projections at the back of the mouth of the vial.

The transfer needle 24 passes axially through the base 37 of the bowl. This needle is retained by a flange 42 which juts out from the housing 30. The flange 42 ensures that the body 16 and the needle 24 are constrained to move together axially.

The needle 24 presents a first end 24A which projects inside the housing 30. This end is adapted to puncture the inner capsule 26 obturating the vial 14.

The needle 24 extends on the other side of the base 37 over most of the length of the body 16. On this side of the base 37 it presents an end 24B for puncturing the carpule piston.

Furthermore, the body 16 features a tubular shaft 50 which extends the cylindrical wall 32 of the cap. The tubular shaft 50 surrounds the lateral wall 36. An annular space 52 is defined between the cylindrical wall 36 and the bottom end of the tubular shaft 50.

The tubular shaft 50 features longitudinal slits and windows which ensure the flexible interlocking of projections incorporated on the moving element 20 retaining the carpule and on the distance sleeve 22.

At a bottom end, the distance sleeve 22 features a bell-shaped seat 60 adapted to engage around the bowl 34. At its other free end it features a profile 62 for fastening to and resting on the piston of the carpule.

To be more specific, the distance sleeve 22 presents a cylindrical wall 64 which axially surrounds the needle 24. The external diameter of the cylindrical wall 64 is smaller than the internal diameter of the reservoir of the carpule, so as to enable the distance sleeve to penetrate the carpule.

The seat 60 has come from material on the end of the cylindrical wall 64. Said seat features a peripheral skirt 66 adapted to be received in the annular space 52. Said skirt is joined to the cylindrical wall 64 by a collar 68.

Figure 3:
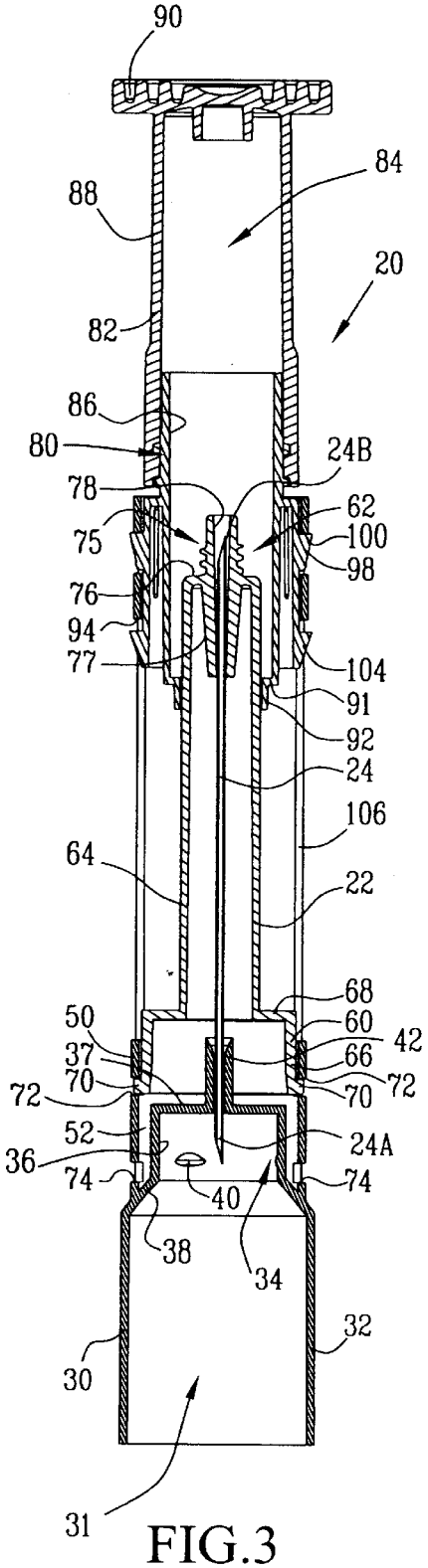
FIG. 3 is a longitudinal sectional view of the transfer device, depicted without the vial and carpule.

At its free end, the outside of the skirt 66 features two diametrically opposed snap-fit projections 70. As illustrated in FIG. 3, these projections are adapted to be received in two windows 72 incorporated in the tubular shaft 50 of the body. These windows 72 are set spaced apart from the cap 30.

Two identical windows 74 are set close to the cap 29 and are adapted to receive the snap-fit projections 70 following displacement of the distance sleeve 22 along the needle 24 towards the vial 14.

At the other end of the cylindrical wall 64, the profile 62 for fastening and supporting the puncturable piston of the carpule incorporates a threaded connector 75 which extends axially within the continuation of the cylindrical wall 64. This threaded connector has a small external diameter and is externally threaded in a manner adapted to cooperate with a thread incorporated in a threaded recess in the puncturable carpule piston 27.

A shoulder 76 is incorporated on the end of the cylindrical wall 64 in order to provide the link between said wall 64 and the connector 75. The shoulder furthermore enables the piston of the carpule to be supported.

The connector 75 is extended inside the cylindrical body by a flange 77. The connector 75 and the flange 77 internally delimit a passage 78 for guiding the needle 24 and, more particularly, the end section thereof terminating in the perforation end 24B. The dimensions of the needle 24 and of the various constituents of the distance sleeve 22 are such that when the distance sleeve 22 is in its initial position, with the snap-fit projections 70 received in the windows 72 (FIGS. 3 and 4), the perforation end 24B of the needle is disposed inside the passage 78.

The moving element 20 for supporting and displacing the reservoir of the carpule includes a carpule support 80 and a cover 82 screwed onto the carpule support. Between them they delimit a housing 84 for axially immobilising the reservoir 25 of the carpule.

The carpule support 80 features a tubular section 86 whose internal diameter corresponds to the external diameter of the reservoir 25. On its external surface said tubular section features a thread adapted to cooperate with a complementary thread on the end of the cover 82. The latter has a cylindrical side wall 88 in which the tubular section 86 supporting the carpule is partially received. This side wall 88 is obturated by a transverse wall 90 which forms a surface for resting the hand.

At its opposite extremity to the cover 82, the cylindrical section features a collar 91 which forms a shoulder for supporting the rear extremity of the reservoir. The collar 91 is extended by a peripheral lip 92 which runs round the cylindrical wall 64 of the distance sleeve so as to provide axial guidance for the moving element 20 with respect to the distance sleeve 22.

Moreover, the support 80 features an outer skirt 94 which runs round the tubular section 86 between the thread allowing the cover 82 to be attached and the end of the section 86 that is equipped with the lip 92. On the outside, said skirt 94 features a first pair of diametrically opposed snap-fit projections 98 which are adapted to be initially received in two windows 100 set close to the top end of the tubular section of the body. Furthermore, another pair of diametrically opposed projections 104 is externally incorporated, on the free end of the skirt 94. These projections are received in diametrically opposed longitudinal slots 106 which extend for most of the length of the tubular shaft 50 of the body.

The way in which the transfer device works will now be outlined with reference to FIGS. 3 to 7.

Initially the device is in the storage state represented in FIG. 3. In this state there is neither a vial nor a carpule positioned in the device.

The carpule 12 is first of all positioned in the moving element 20, as illustrated in FIG. 4. To this end, the cover 82 is unscrewed from the carpule support 80. The carpule is then introduced with its rear extremity engaged in the space delimited by the cylindrical section 86. The puncturable piston 27 is screwed onto the connector 75 of the distance sleeve. In this position, the rear extremity of the carpule rests against the collar 91 of the carpule support 80. The stopper 82 is now screwed back onto the carpule support 80. This screwing action is continued until the transverse wall 90 of the cover is resting on the front end of the carpule, with the result that the reservoir 25 of the carpule is constrained to move axially with respect to the moving element 20.

Next the vial 14 is engaged in the housing 30, as illustrated in FIG. 4. The vial 14 is retained in the housing 30 by the flexible interlocking projections 40 applied against the shoulder 29.

At the same time as the mouth is being positioned in the cover 20, the puncturable inner capsule 28 is punctured by the transfer needle 24, from the extremity 24A thereof.

In this position a pressure is now applied to the cover 90 which tries to draw the latter closer to the body 50. Under the action of this pressure, the projections 70 which initially immobilise the distance sleeve 22 in its initial position become disengaged from the windows 72, thus enabling the distance sleeve 22 and the puncturable piston constrained to move therewith to be displaced in the direction of the vial 14 along the needle 24. This displacement continues until the snap-fit projections 70 have been received in the windows 74.

Simultaneously, the moving element 20 is made to move along the body. Specifically, the snap-fit projections 98 become disengaged from the windows 100, thereby permitting the moving element 20 to slide inside the tubular shaft 50 of the body.

Figure 5:
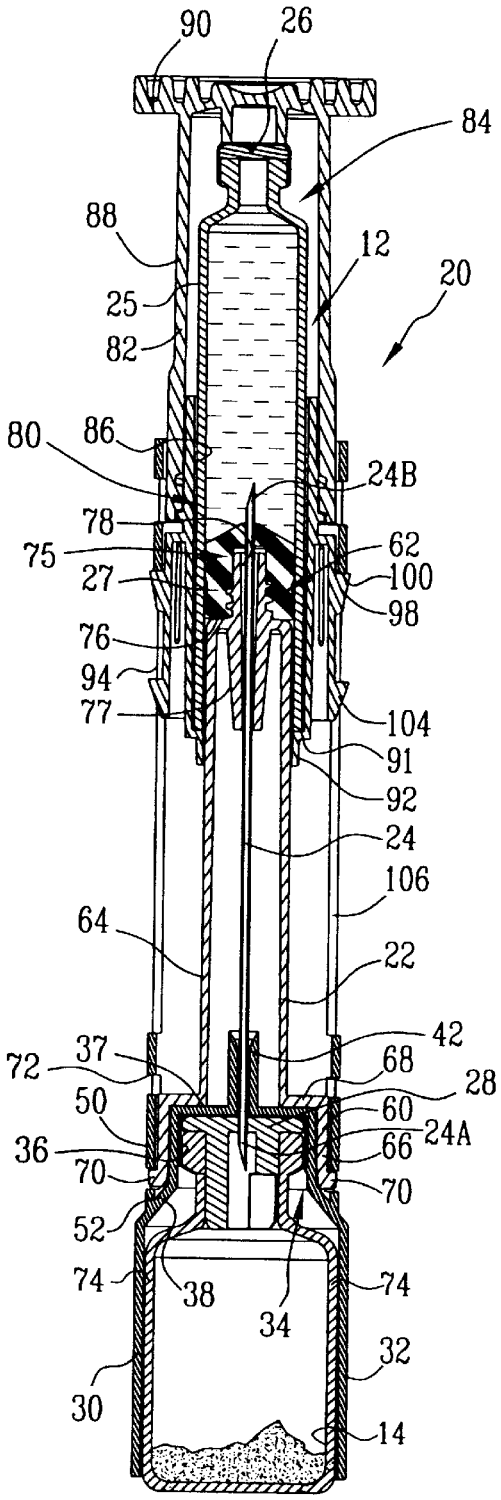

At the moment of said displacement, the carpule piston 27 is punctured by the end 24B of the needle, such that at the end of the displacement of the distance sleeve 22, and as illustrated in FIG. 5, the vial 14 and the carpule 12 are communicating through the needle 24.

As the displacement progresses, the punctured piston of the carpule is kept resting on the distance sleeve 22 and is thus immobilised with respect to the body. Since the body of the carpule is displaced by sliding the moving element 20 along, a relative displacement takes place between the piston and the carpule body, with the piston being progressively driven into the body. The liquid contained in the carpule is then ejected through the needle 24 and into the vial 14.

The projections 104 received in the longitudinal slots 106 provide translatory guidance and rotational immobilisation of the moving element with respect to the body. During the sliding action the snap-fit projections 98 are likewise received in the slots 106.

Figure 6:
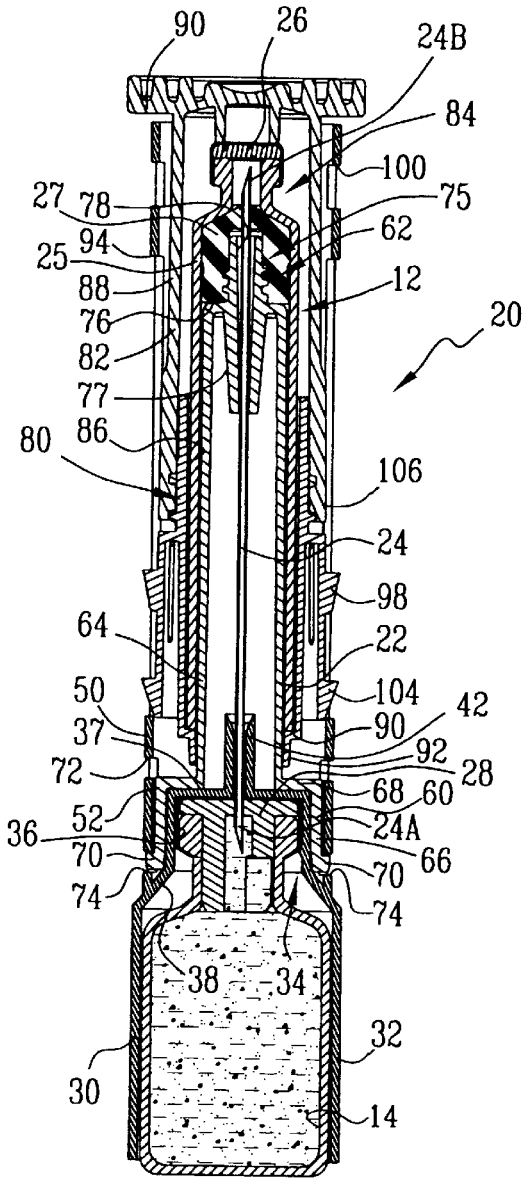
Figure 7:
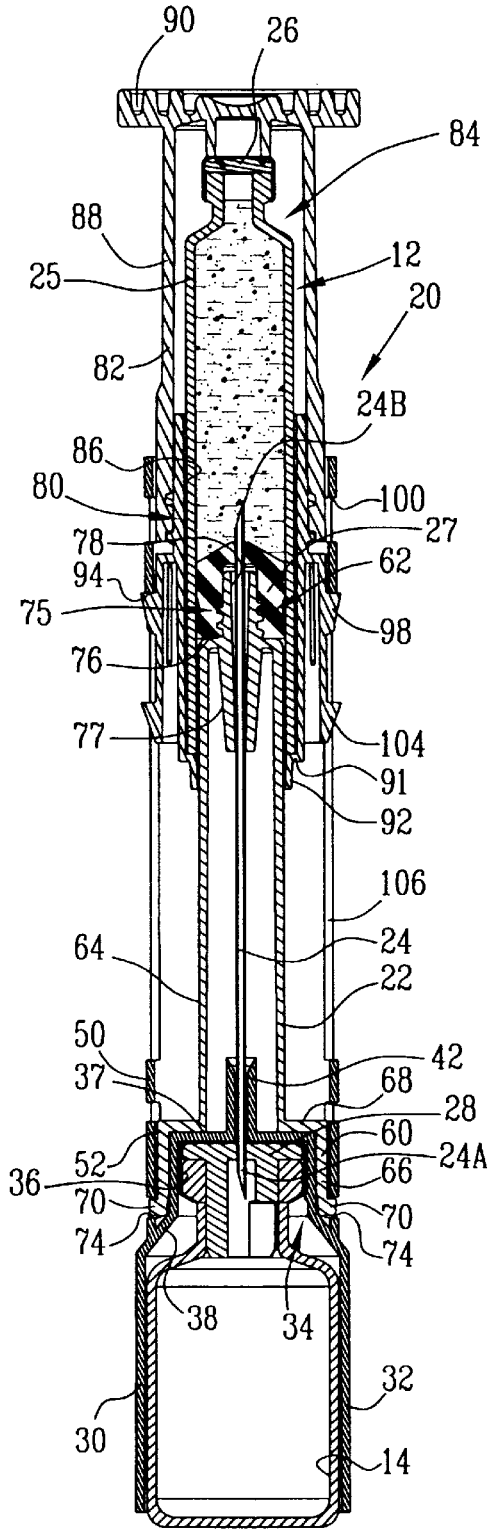

Displacement is continued until the piston 27 reaches the front end of the carpule, as illustrated in FIG. 6.

In this position the device is shaken gently in order to ensure that the freeze-dried substance dissolves in the solvent initially contained in the carpule.

In order to bring about re-transfer of the mixture contained in the vial 14, the device is completely turned around. Accordingly, the vial 14 is situated above the carpule. In particular, the end 24A of the needle is situated in the lower part of the vial, enabling most of the mixture contained therein to be drawn off by aspiration. Aspiration is ensured by the moving element 20 which is drawn away from the vial 14. To this end, the body 16 is held in one hand whilst pulling the cover 90 in the direction of the needle. At the time of this displacement the piston 27 through which the needle 24 runs is kept immobilised with respect to the body by virtue of the interlocking of the snap-fit projections 70 in the windows 74. Conversely, the moving element 20 with which the cylindrical reservoir 25 is constrained to move travels inside the body towards the needle 24, with the result that the piston moves with respect to the cylindrical reservoir, thereby creating a depression in the carpule which causes the recall of the mixture contained in the vial 14.

The displacement of the moving element 20 is interrupted when the snap-fit projections 98 reach the top end of the longitudinal slots 106. The presence of the projections 98 and of the limit stops formed by the ends of the slots 106 makes it possible to prevent the moving element 20 from travelling too far from the body, thereby avoiding any risk of the piston 27 being accidentally pulled out of the reservoir 25.

The cover 82 is then disassembled and the carpule is withdrawn from the moving element. This carpule is now used to give an injection, after fitting it with an injection needle and a push-rod screwed into the puncturable piston.

What is claimed is:

1. Device for the bidirectional transfer of a liquid between a vial (14) equipped with a puncturable stopper (28) and a carpule (12) comprising a cylindrical reservoir (25) in which slides a puncturable piston (27), said device comprising:

a body (16) having means (18) for fastening on the vial (14);

a hollow needle (24) featuring a first extremity (24B) for puncturing the piston (27) of the carpule and a second extremity (24A) adapted for puncturing the stopper (28) of the vial;

a moving element (20) which is displaceable with respect to the body (16) along the axis of the needle (24), said moving element (20) having means for constraining the reservoir (25) of the carpule to move axially along the axis of the needle (24); and a distance sleeve (22) interposed between the body (16) and the puncturable piston (27) of the carpule, said distance sleeve (22) forming a limit stop for the puncturable piston (27) with respect to the body (16), characterized in that the hollow needle (24) is rigidly joined to the body (16) and is axially fixed with respect to the body (16).

2. Transfer device according to claim 1, characterized in that said distance sleeve (22) is displaceable with respect to the body (16) between an initial position in which it holds the puncturable piston (27) spaced apart from the first extremity (24B) of the needle and a final position in which the needle (24) is engaged through the puncturable piston (27).

3. Transfer device according to claim 1, characterized in that the moving element (20) and the body (16) have means (98, 106) for limiting the displacement of the moving element (20) with respect to the body (16) in the direction in which the puncturable piston (27) is withdrawn from the cylindrical reservoir (25).

4. Transfer device according to claim 1, characterized in that the moving element (20) and the body (16) have means (104, 106) for translatory guidance and rotational immobilization in relation to one another.

* * * * *